US009046809B2

(12) United States Patent
Watanabe et al.

(10) Patent No.: US 9,046,809 B2
(45) Date of Patent: Jun. 2, 2015

(54) IMAGE FORMING APPARATUS

(71) Applicant: CANON KABUSHIKI KAISHA, Tokyo (JP)

(72) Inventors: Yasunari Watanabe, Suntou-gun (JP); Hideaki Hasegawa, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 97 days.

(21) Appl. No.: 13/693,463

(22) Filed: Dec. 4, 2012

(65) Prior Publication Data

US 2013/0142528 A1 Jun. 6, 2013

(30) Foreign Application Priority Data

Dec. 6, 2011 (JP) ..... 2011-267151
Nov. 8, 2012 (JP) ..... 2012-246487

(51) Int. Cl.
*G03G 15/00* (2006.01)
*G03G 15/045* (2006.01)
*G03G 15/043* (2006.01)

(52) U.S. Cl.
CPC ..... *G03G 15/045* (2013.01); *G03G 15/043* (2013.01)

(58) Field of Classification Search
CPC ..... G03G 15/2078; G03G 2215/00586; G03G 15/0142; G03G 15/041
USPC ..... 399/26, 46, 178, 328, 228, 69
See application file for complete search history.

(56) References Cited

U.S. PATENT DOCUMENTS

2005/0276619 A1* 12/2005 Taguchi et al. ..... 399/27

FOREIGN PATENT DOCUMENTS

| | | | |
|---|---|---|---|
| JP | 4-22977 | A | 1/1992 |
| JP | 8-171260 | A | 7/1996 |
| JP | 2006-221048 | A | 8/2006 |
| JP | 2008-139514 | A | 6/2008 |

* cited by examiner

*Primary Examiner* — Roy Y Yi
(74) *Attorney, Agent, or Firm* — Canon U.S.A., Inc. IP Division

(57) ABSTRACT

An image forming apparatus includes a photosensitive member, a charging unit, an image exposure unit configured to form image portion potential by exposing the photosensitive member to light, a weak exposure unit configured to form non-image portion potential by exposing the photosensitive member to weak light having a lower exposure amount than the light for forming the image portion potential, and a developer bearing member configured to carry developer, wherein a relationship of Ldev<Lvd<Lbg is satisfied, where the photosensitive member exposed to the weak light by the weak exposure unit has a weak exposure area having a length of Lbg in a photosensitive member longitudinal direction, a length of the developer carried by the developer bearing member in the photosensitive member longitudinal direction is Ldev, and the photosensitive member charged by the charging unit has a charging area having a length of Lvd.

12 Claims, 8 Drawing Sheets

IMAGE FORMING APPARATUS

BACKGROUND OF THE INVENTION

1. Field of the Invention

The present invention relates to an image forming apparatus for forming an image on a recording medium. The image forming apparatus includes, for example, an electrophotographic image forming apparatus employing an electrophotographic method. Specifically, the image forming apparatus includes a laser beam printer, a copying machine, and a facsimile machine.

2. Description of the Related Art

An electrophotographic image forming apparatus uniformly charges a surface of a photosensitive member serving as an image bearing member with a predetermined polarity, and forms an electrostatic latent image based on image data. The electrostatic latent image is developed with toner (developer) to form a toner image (a developer image). This toner image is transferred to a recording medium such as a sheet, and is fixed to the recording medium by heat and pressure in a fixing device.

As for a charging unit, a roller charging method using a conductive roller for a charging member is widely used.

A charging roller serving as the conductive roller has proper elasticity to be in contact with a photosensitive drum at a certain level. When a certain voltage or higher is applied while the charging roller is being in contact with the photosensitive drum, a surface potential of the photosensitive drum begins to rise and then linearly increases according to the applied voltage.

When this threshold voltage is defined as a charge start voltage Vth, a direct current (DC) voltage of V0+Vth needs to be applied to a charging roller to acquire a photosensitive member surface voltage (hereinafter referred to as a primary charging potential Vd0) needed for an electrophotographic image forming process. Such a charging method is referred to as a direct current charging method.

In the direct current charging method, for example, Japanese Patent Application Laid-Open No. 8-171260 discusses a technique as one method for enhancing uniformity of a surface potential of a photosensitive member. Such a technique is described with reference to FIG. 8.

In Japanese Patent Application Laid-Open No. 8-171260, the photosensitive member is once overcharged to a primary charging potential Vd0 that exceeds a potential needed for image formation by a primary charging device. After the primary charging and before development, an exposure device emits a weak light at a power E1, thereby attenuating (decreasing) the surface potential of the photosensitive member.

Accordingly, potential of the photosensitive member becomes Vd1 which is a target value during image formation. This potential Vd1 is provided in an area where adhesion of toner is not allowed (i.e., a non-image portion) within an image forming area of the photosensitive member. The potential Vd1 is hereinafter referred to as non-image portion potential.

In an area where adhesion of toner is allowed (i.e., an image portion) on the photosensitive member, image portion potential V1 is provided by light emitted at a power E2 by the exposure device.

According to Japanese Patent Application Laid-Open No. 8-171260, this method can prevent generation of a defective image as a conventional problem of the direct current charging method due to overcharge of a photosensitive member.

Meanwhile, potential of the photosensitive member also depends on the sensitivity of the photosensitive member. There are cases where the sensitivity of the photosensitive member changes depending on an amount of light to which a latent image is exposed. For example, when images are formed on different sizes of recording media, a width (a length in a longitudinal direction) on a photosensitive member to be exposed to light is changed so that an electrostatic latent image is formed. That is, a total amount of light exposure changes in a photosensitive member longitudinal direction. Accordingly, there are cases where a change in the sensitivity of the photosensitive member changes potential of the photosensitive member in the longitudinal direction thereof. That is, density unevenness occurs.

Japanese Patent Application Laid-Open No. 4-22977 discusses prevention of the density unevenness by exposing an outer side, which is provided outside of a width in which an electrostatic latent image is formed on a photosensitive member, to light during image formation when a recording medium is small.

An exposable width on the photosensitive member exposed to light by an exposure device can satisfy a width in which a maximum image is formed. In addition, a developing width on the photosensitive member can be wider than the exposable width. The developing width is a width in which a developing device can perform development. Moreover, in a case where an uncharged portion is generated in an area of the photosensitive member corresponding to the developing width, the uncharged portion of the photosensitive member is developed. Thus, a charging width on the photosensitive member is wider than the developing width. The charging width is a width in which a charging device charges a surface of the photosensitive member. Therefore, the following relationship is provided.

Maximum image forming width<exposure width<developing width<charging width

However, in a potential control method where an exposure device emits a weak light subsequent to a primary charging to acquire non-image portion potential Vd1, an exposure width and a width of the non-image portion potential Vd1 become the same. Accordingly, the following relationship is satisfied.

Maximum image forming width<exposure width=non-image portion potential $Vd1$ width<developing width<charging width The developing device includes a developer bearing member for carrying toner serving as developer, and the developing device employing a developing roller method is widely used. Potential used to develop toner on a photosensitive member (hereinafter called a developing bias Vdc) is being applied to a developing roller.

Herein, a relationship among the primary charging potential (a potential of a photosensitive member charged by a charging unit) Vd0, the non-image portion potential (a potential of the photosensitive member exposed to a weak light) Vd1, and the developing bias (a potential of a developing roller) Vdc is as follows:

$$|Vdc|<|Vd1|<|Vd0|$$

An electric potential relationship between the developing bias Vdc and the non-image portion potential Vd1 or the primary charging potential Vd0 has the following restrictions.

First, if a potential difference between Vdc and Vd1 is too large, a toner charged to a polarity opposite to a normal charge polarity is moved to an area of the photosensitive member having the potential of Vd1. Such a toner movement is so-called reversal fog. As a result, a defective image (i.e., a fogged image) caused by adhesion of the toner to a non-image portion is generated. Moreover, if a potential difference is too small, a toner charged to a normal charge polarity is moved to an area of the photosensitive member having the potential of Vd1, causing generation of a fogged image as similar to the case of the big potential difference. Thus, an electric potential relationship between the non-image portion potential Vd1 and the developing bias Vdc in an image region needs to be set appropriately.

However, when there is a conventional length relationship stated below in a photosensitive member longitudinal direction, Non-image portion potential *Vd*1 width<developing width<charging width the photosensitive member remains charged by the primary charging potential Vd0 on an outer side of the non-image portion potential Vd1 width in an area of the developing width.

Consequently, the potential difference between the developing bias Vdc and the primary charging potential Vd0 increases, thereby causing the reversal fog which is adhesion of the toner charged to a polarity opposite to a normal charge polarity to an area having the potential Vd0 of the photosensitive member. Accordingly, the fog occurrence on an end in a photosensitive member longitudinal direction can cause the possibility that a stain is generated on an edge of a sheet serving as a recording medium.

Next, a description is given of another issue regarding an outer side of the non-image portion potential Vd1 width in an area of a charging width where the following conventional length relationship is provided in a photosensitive member longitudinal direction.

Non-image portion potential *Vd*1 width<developing width<charging width

The potential outside the non-image portion potential Vd1 width in an area of a charging width on the photosensitive member is the primary charging potential Vd0. The non-image portion potential Vd1 is provided by attenuating (decreasing) potential of the photosensitive member from a value of the primary charging potential Vd0 by exposure of a weak light by an exposure device (weak exposure device). This resolves the issue of the direct current charging method.

Therefore, the potential of the photosensitive member is attenuated by the weak light emitted by the exposure device. The greater the attenuation amount, the more the effect. When an absolute value of the primary charging potential Vd0 is greater, the weak light of the exposure device can provide a greater amount of attenuation potential of the photosensitive member.

However, when an absolute value of the primary charging potential Vd0 is greater, the photosensitive layer has the possibility of undergoing dielectric breakdown. The photosensitive member includes a photosensitive layer formed on a surface of a cylinder made of metal such as aluminum. The photosensitive layer serves as the photosensitive member. This photosensitive layer is an insulator, and electric charge charged by primary charging is retained on a surface of the photosensitive layer.

When electric charge on the surface of the photosensitive member is greater, there is a possibility that withstand voltage of the photosensitive layer is exceeded, causing dielectric breakdown of the photosensitive layer. Moreover, when electric charge is retained on the surface of the photosensitive member for a long period, there is a possibility that dielectric breakdown of the photosensitive layer occurs. In case of dielectric breakdown of the photosensitive layer, an electric current at the time of primary charging by a charging member flows into the area having undergone the dielectric breakdown. As a result, a voltage necessary to charge the photosensitive member by the charging member cannot be maintained, thereby causing generation of an image with faulty charging.

SUMMARY OF THE INVENTION

The present invention is directed to an image forming apparatus capable of suppressing a fog occurrence in an end portion of a photosensitive member and generation of a defective image due to faulty charging of the photosensitive member.

According to an aspect of the present invention, an image forming apparatus for forming an image on a recording medium includes a photosensitive member, a charging unit configured to charge the photosensitive member, an image exposure unit configured to form image portion potential by exposing the photosensitive member to light after the photosensitive member is charged by the charging unit, a weak exposure unit configured to form non-image portion potential by exposing the photosensitive member to weak light having a lower exposure amount than the light for forming the image portion potential after the photosensitive member is charged by the charging unit, and a developer bearing member configured to carry developer for forming a developer image by causing the developer to adhere to a portion of the image portion potential, wherein a relationship of Ldev<Lvd<Lbg is satisfied where the photosensitive member exposed to the weak light by the weak exposure unit has a weak exposure area having a length of Lbg in a photosensitive member longitudinal direction, a length of the developer carried by the developer bearing member in the photosensitive member longitudinal direction is Ldev, and the photosensitive member charged by the charging unit has a charging area having a length of Lvd in the photosensitive member longitudinal direction.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
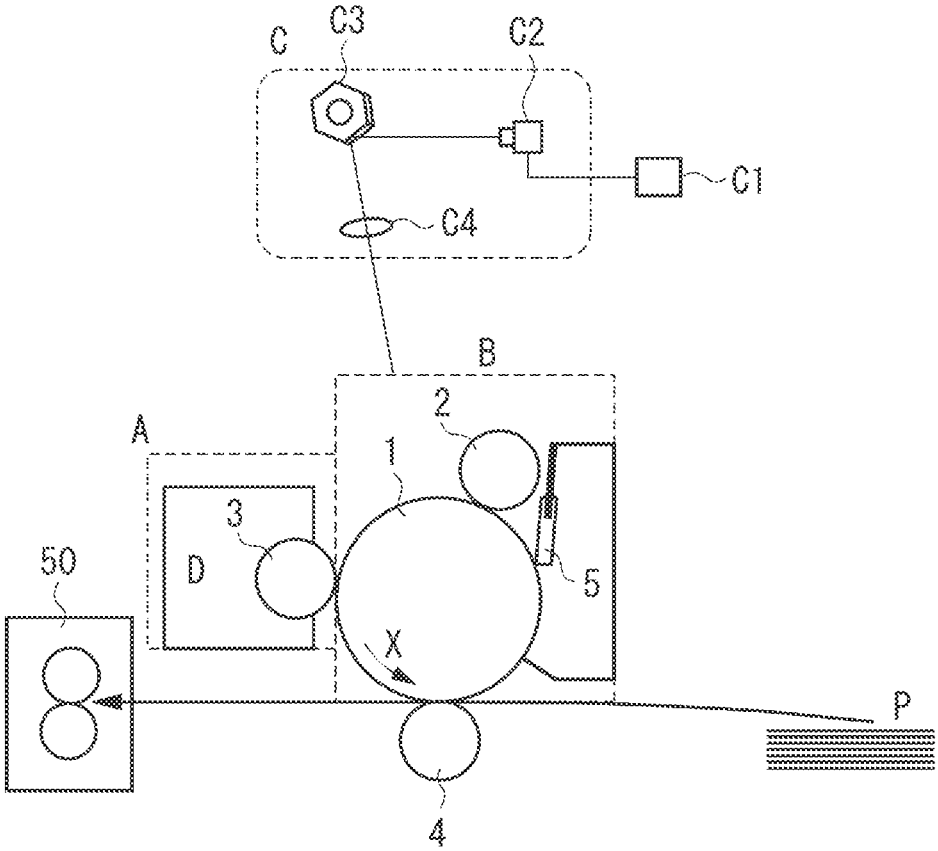
FIG. 1 is a diagram illustrating a schematic configuration of an image forming apparatus.

FIG. 1 is a diagram illustrating a schematic configuration of an image forming apparatus according to a first exemplary embodiment of the present invention.

The image forming apparatus includes a photosensitive drum 1 serving as an image bearing member, a charging roller 2 (a charging unit) serving as a charging device, a developing device A serving as a developing unit, a transfer roller 4 serving as a transfer device, and a cleaning blade 5.

The developing device A includes a developing roller 3 serving as a developer bearing member. The charging roller 2, the developing roller 3, the transfer roller 4, and the cleaning blade 5 are disposed in contact with the photosensitive drum 1.

Figure 2A:
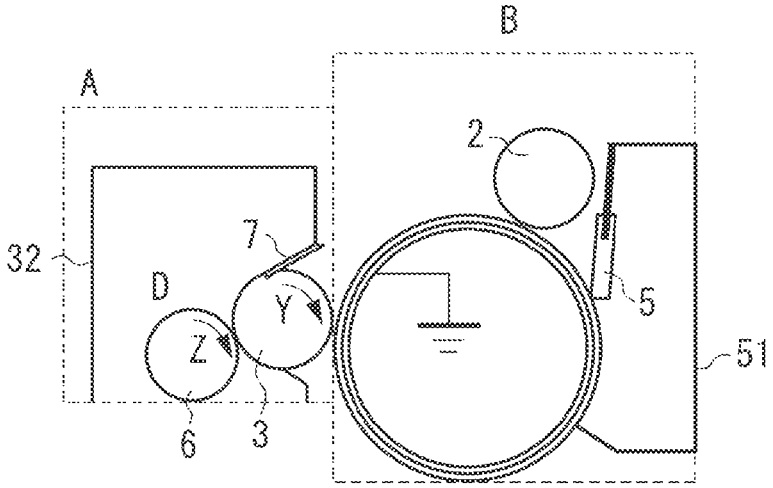
FIGS. 2A and 2B are schematic cross-sectional views respectively illustrating a process cartridge and a photosensitive drum according to an exemplary embodiment of the present invention.

A photosensitive drum unit B of the present exemplary embodiment is described in detail with reference to FIG. 2A. FIG. 2A is a schematic cross-sectional view illustrating a process cartridge.

The photosensitive drum 1, the charging roller 2, and the cleaning blade 5 are disposed on a waste developer container 51, and are integrated as the photosensitive drum unit B.

Figure 2B:
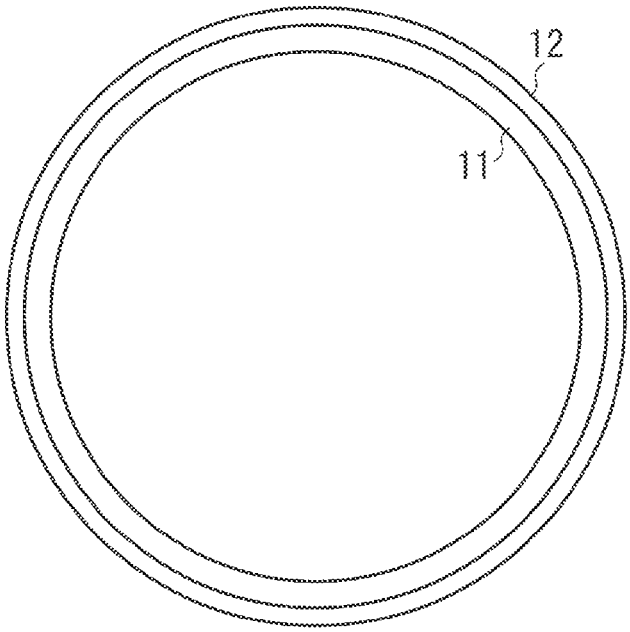

The photosensitive drum 1 of the present exemplary embodiment is described in detail with reference to FIG. 2B. The photosensitive drum 1 includes a cylindrical supporting member 11 made of aluminum, and a photosensitive layer 12 formed on the cylindrical supporting member 11.

The aluminum cylindrical supporting member 11 needs to have conductivity so that electric charge flows to the ground. Particularly, the aluminum cylindrical supporting member 11 can have a volume resistivity of $1\times10^{10}\Omega\cdot$cm or less, and suitably $1\times10^{6}\Omega\cdot$cm or less.

The photosensitive layer 12 can be a single-layer-type photosensitive layer including a charge transport substance and a charge generation substance in the same layer, or a laminated-type (function separate type) photosensitive layer in which a charge generation layer including a charge generation substance and a charge transport layer including a charge transport substance are separated. The laminated-type photosensitive layer may be suitable from a viewpoint of electrophotographic properties.

Moreover, the laminated-type photosensitive layer includes an ordered-layer-type photosensitive layer and a reversed-layer-type photosensitive layer. The ordered-layer-type photosensitive layer includes a charge generation layer and a charge transport layer laminated in this order from a supporting member side, whereas the reversed-layer-type photosensitive layer includes a charge transport layer and a charge generation layer laminated in this order from the supporting member side. The ordered-layer-type photosensitive layer may be suitable from a viewpoint of electrophotographic properties.

This photosensitive layer 12 is an insulator, and has a thickness of 5 to 30 μm. The photosensitive layer 12 is worn and whittled by an image forming operation, and a thickness thereof becomes thinner. Thus, a thickness of the photosensitive layer 12 is changed depending on an expected usage amount or an expected abrasion amount of the photosensitive drum unit B or the photosensitive drum 1. Both ends of the photosensitive drum 1 are rotatably supported by a frame member of the photosensitive drum unit B.

The cleaning blade 5 is supported by the photosensitive drum unit B to clean the toner on a surface of the photosensitive drum 1.

The charging roller 2 serving as a charging device includes a rubber layer or a resin layer on a metal shaft surface. The charging roller 2 presses against the photosensitive drum 1 with a predetermined load. A charging bias applying unit applies a charging bias as a direct current voltage to the charging roller 2 with a predetermined output. The photosensitive drum 1 is charged to the same polarity (a negative polarity in the present exemplary embodiment) as a normal polarity of toner by the charging roller 2.

The developing device A is hereinafter referred to as a developing unit A. The developing unit A of the present exemplary embodiment is described in detail with reference to FIG. 2A.

In the developing unit A, the developing roller 3 and a developer supplying roller 6 are rotatably supported by a developer containing unit 32. The developer supplying roller 6 is disposed to contact a circumferential surface of the developing roller 3. The developing roller 3 and the developer supplying roller 6 rotate in the same directions (in opposite directions on circumferential surfaces of contact portions) indicated by respective arrows Y and Z illustrated in FIG. 2A.

The developing roller 3 includes a conductive elastic rubber layer on a circumference of a metal core, the conductive elastic rubber layer having a predetermined volume resistivity. The developer supplying roller 6 includes a urethane foam layer on a circumference of a metal core. This urethane foam layer has a surface on which a foam cell is open, thereby facilitating retention and conveyance of a developer D. In the present exemplary embodiment, a normal charge polarity (normal polarity) of the developer is a negative polarity.

A developing blade 7 includes an elastic plate made of phosphor bronze or SUS having flexibility. The developing blade 7 is disposed in such a manner that one end thereof is fixed to the developer container 31 while a plate surface near a free end thereof rubs a surface of the conductive elastic rubber layer of the developing roller 3.

The developer D inside the developer containing unit 32 (inside the developing unit) is stirred and conveyed toward the developer supplying roller 6 with rotation of a developer stirring member 33 inside the developer containing unit 32.

The developer D retained in the foam urethane layer of the developer supplying roller 6 is conveyed to a contact portion between the developing roller 3 and the developer supplying roller 6 with rotation of the developer supplying roller 6. Upon reaching the contact portion, the developer D is rubbed by surfaces of the developing roller 3 and the developer supplying roller 6 which move in opposite directions, and one portion thereof is transferred and adheres to a surface of the developing roller 3.

The developer D attached to the surface of the developing roller 3 is conveyed to the developing blade 7 with rotation of the developing roller 3. The developing blade 7 regulates an amount of the developer D attached to the surface of the developing roller 3 to form a uniform thin layer, and triboelectrically charges the developer D.

The thin layered developer D is then conveyed to a contact portion between the developing roller 3 and the photosensitive drum 1 with rotation of the developing roller 3, and is used to develop a latent image on the photosensitive drum 1. The developer D remaining on the surface of the developing roller 3 without being used for development is conveyed to the contact portion between the developing roller 3 and the developer supplying roller 6, and is removed from the surface of the developing roller 3 by the developer supplying roller 6. The removed developer D is conveyed inside the developer containing unit 32, and is stirred and mixed with the developer inside the developer containing unit 32.

An exposure unit includes an exposure unit C (see FIG. 1). The exposure unit C is a laser scanner unit. The exposure unit C collimates a laser beam output from a laser diode (a laser emitting unit) C2, and performs scanning using a polygonal mirror C3.

After passing through a series of lenses (a lens group) C4, the laser beam is applied to the photosensitive drum 1. Herein, the exposure unit C can output a plurality of laser power levels. A laser power-outputting unit C1 can output at least two laser power levels to the exposure unit C by changing an electric current to be applied to the laser diode C2.

That is, the laser power-outputting unit C1 outputs a surface potential controlling laser power E1 for regulating potential on the entire surface of the photosensitive drum 1, and an image forming laser power E2 for regulating potential of an image forming area of the photosensitive drum 1. These laser power levels are switched by a control signal from a laser power control unit (not illustrated), and the laser beam is applied to the photosensitive drum 1.

Figure 8:
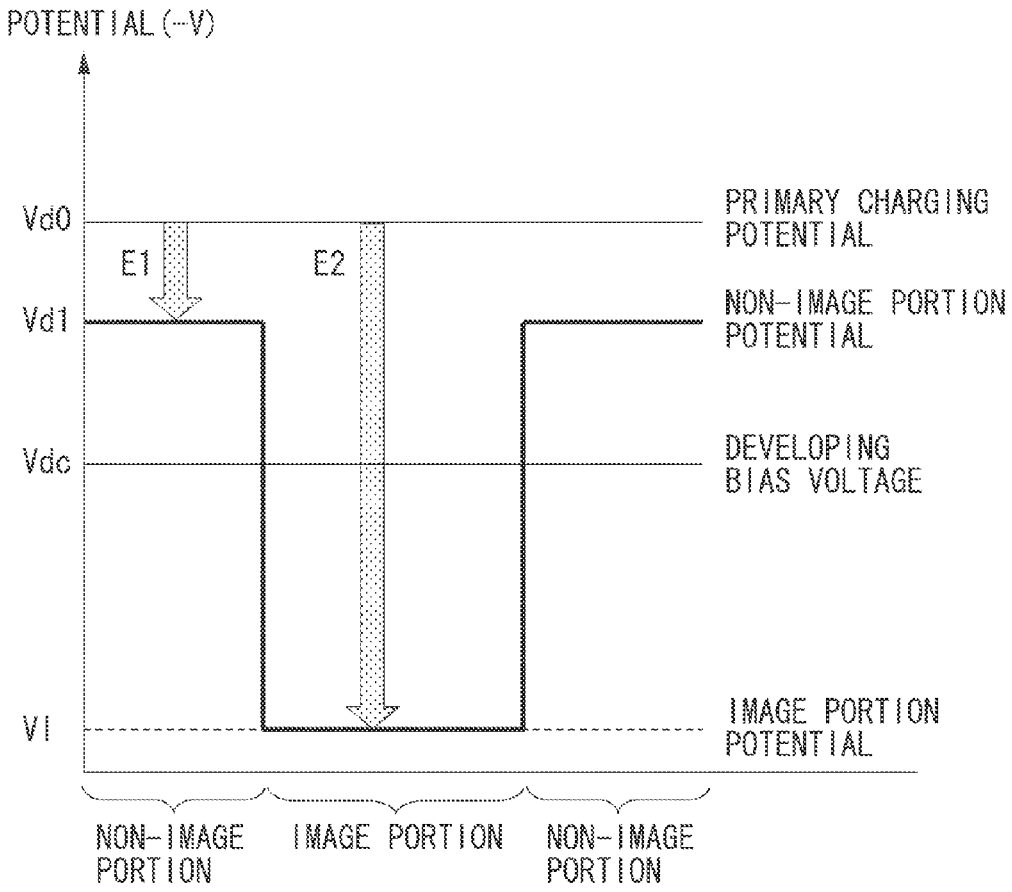
FIG. 8 is a diagram illustrating potential of the photosensitive drum.

An image forming operation of the image forming apparatus is now described with reference to FIG. 1. The photosensitive drum 1 is rotated by a driving device (not illustrated) at a predetermined speed in a direction indicated by an arrow X illustrated in FIG. 1. The charging roller 2 receives a charging bias of −1300 V applied by a power source (not illustrated). For example, in the environment with temperature of 25° C. and relative humidity (RH) of 65%, a surface of the photosensitive drum 1 is charged to Vd0=−700 V. FIG. 8 illustrates potential of the photosensitive drum 1.

After being charged by the charging roller 2, the charged surface of the photosensitive drum 1 is moved to an exposure unit and is exposed to a weak light at the surface potential controlling laser power E1 so that non-image portion potential Vd1 is generated. The potential Vd1 is −500 V.

Moreover, the charged surface of the photosensitive drum 1 undergoes image exposure at the image forming laser power E2 so that image portion potential V1 is generated, the image portion potential V1 causing toner to be developed in a latter developing process. The potential V1 is −100 V.

The charged surface of the photosensitive drum 1 charged by the charging roller 2 is exposed to the weak light at the surface potential controlling laser power E1, so that the potential thereof is attenuated from Vd0 (−700 V) to Vd1 (−500 V). In other words, the weak exposure at the surface potential controlling laser power E1 is exposure using the light weaker than (lower than the image forming laser power E2) an exposure amount used to form the image portion potential.

Therefore, an electrostatic latent image including the image portion V1 to be developed as a toner image and the non-image portion Vd1 is conveyed to a developing unit. In the present exemplary embodiment, a weak exposure unit (a unit for exposing a non-image portion to a weak light) and an image exposure unit for exposing an image portion to a light are shared. That is, the weak exposure (non-image portion exposure) and the image portion exposure are performed by the same exposure unit (the exposure unit C).

In the developing unit, the toner (developer) supplied by the developing roller 3 adheres to an area of the image portion potential V1, thereby visualizing the area as a toner image (a developer image). In the present exemplary embodiment, non-magnetic one component developer is used as the developer D. A developing bias Vdc (−350 V) is applied between the developing roller 3 and the photosensitive drum 1 by a power source (not illustrated). Such potentials have an absolute value relationship as follows.

$$|Vd0|>|Vd1|>|Vdc|>|V1|$$

A detailed setting of an amount of applied voltage of the developing bias Vdc is described below.

The visualized developer image is further conveyed to a contact portion of the transfer roller 4, and is transferred to a recording material P conveyed at a corresponding timing. A transfer bias is being applied between the transfer roller 4 and the photosensitive drum 1 by a power source (not illustrated).

The recording material P with the transferred developer image is conveyed to a fixing device 50. In the fixing device 50, heat and pressure are applied to the recording material P, thereby fixing the transferred developer image to the recording material P.

On the other hand, the developer D remaining on the photosensitive drum 1 without being transferred is scraped by the cleaning blade 5, and is stored inside the waste developer container 51. Upon removal of the remaining developer, the surface of the photosensitive drum 1 is again charged by the charging roller 2, so that the image forming operation is repeated.

In the image forming apparatus illustrated in FIG. 1, the photosensitive drum unit B and the developing unit A are integrated and are attachable/detachable as a process cartridge to/from an image forming apparatus main body.

Herein, a description is given of a relationship among lengths in a photosensitive member longitudinal direction in the image forming apparatus having a maximum sheet-passing width of an LTR sheet.

Figure 3:
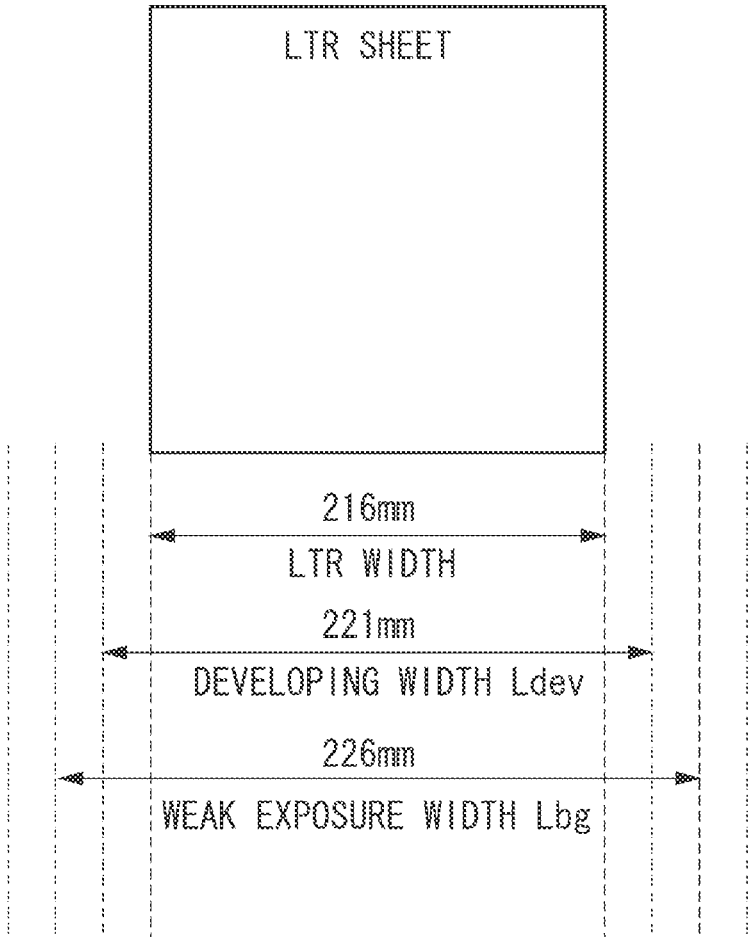
FIG. 3 is a diagram illustrating a relationship among lengths in a photosensitive member longitudinal direction of an image forming apparatus according to a first exemplary embodiment of the present invention.

FIG. 3 is a diagram illustrating a relationship among lengths in a photosensitive member longitudinal direction in the image forming apparatus. The LTR sheet has a width of 216 mm. In a conventional image forming apparatus, since an electrostatic latent image is formed across the entire width of the LTR sheet, a laser beam irradiation width needs to be wider than the width of the LTR sheet, the laser beam irradiation width being a width for image formation by an exposure unit C.

That is, the following relationship is set.

*LTR* sheet width<laser beam irradiation width

In addition, an LTR sheet width tolerance, position accuracy of LTR sheet conveyance in the image forming apparatus, and accuracy or tolerance of a laser beam irradiation position need to be considered. Herein, a margin length is set every 5 mm with consideration of these tolerance and accuracy. The laser beam irradiation width becomes 221 mm or more.

A margin length should be set in view of length tolerance of a component and setting tolerance. However, the following length setting, a margin length is set to 5 mm for the sake of convenience.

In the conventional image forming apparatus, when a margin length is set to 5 mm, a laser beam irradiation width is set to a minimum length of 221 mm since the LTR sheet width and the laser beam irradiation width have the following relationship.

*LTR* sheet width<laser beam irradiation width

However, in the present exemplary embodiment, since the weak exposure (non-image portion exposure) and the image exposure are performed by the same exposure unit, laser beam irradiation widths need to be set in consideration of respective lengths necessary to perform the weak exposure and the image portion exposure.

If an image exposure width as an exposure width for image formation is wider than the LTR width as the maximum sheet-passing width which can be handled by the image forming apparatus, an image can be formed across the entire LTR sheet.

A developing width, in a photosensitive member longitudinal direction, is a length Ldev of the developer carried by the developing roller 3. The developer needs to be reliably supplied to a latent image formed on the photosensitive drum 1 so that a developer image is formed. Consequently, the developing width is longer than the width of the LTR sheet. Moreover, a surface of the photosensitive drum 1 including an area corresponding to the developing width needs to be reliably charged by the charging device. If there is an uncharged a surface portion, developer adheres to that portion. Such adhesion of developer causes a stain on the transfer roller 4 or a stain on an edge of a sheet. Accordingly, the following relationship is provided.

Developing width *Ldev*<charging roller width *Lvd*

Figure 4:
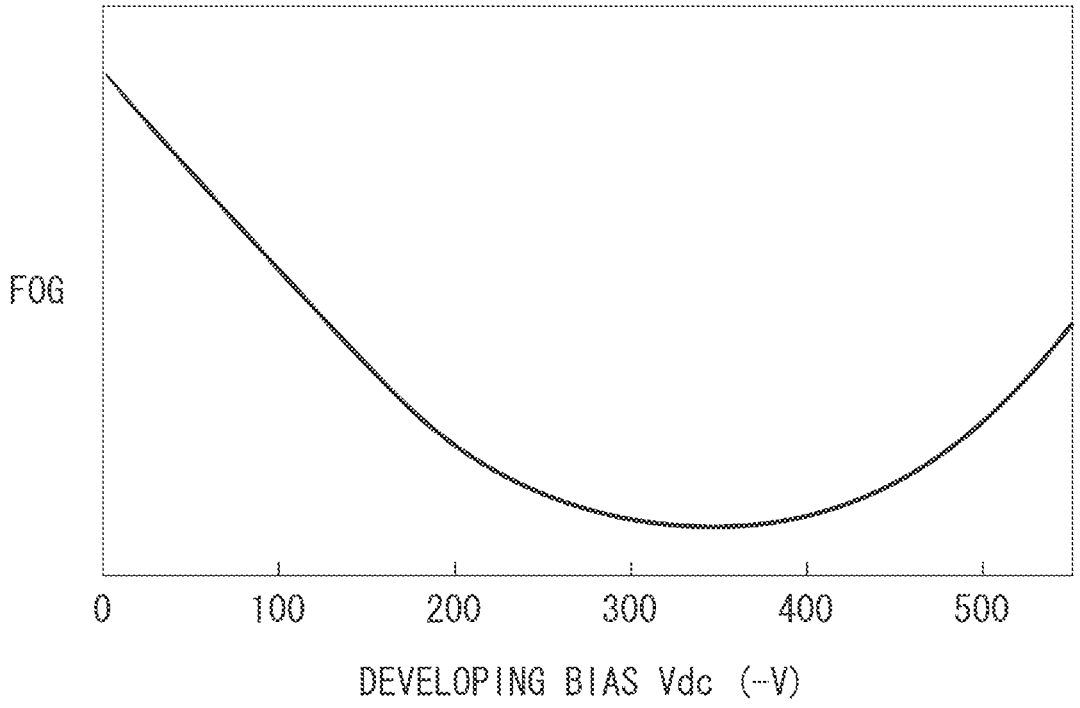
FIG. 4 is a graph illustrating a relationship between a developing bias Vdc and an amount of fog to occur in an area of potential Vd on a surface of the photosensitive drum.

Now, setting of the developing bias Vdc is described. FIG. 4 is a graph illustrating a relationship between the developing bias Vdc and an amount of fog occurring with respect to an area of potential Vd on a surface of the photosensitive drum 1 when the potential Vd on the surface of the photosensitive drum 1 is −500 V. The higher the position in a vertical axis, the greater the amount of fog.

When the developing bias Vdc is approximately −350 V, the fog amount is minimum. The fog tends to occur as the developing bias Vdc increases in a negative direction (approaching −500 V of the potential Vd of the photosensitive drum 1). This phenomenon occurs when a normal polarity toner is provided to develop potential of a photosensitive drum 1, and is so-called a normal fog phenomenon.

A certain potential difference from the potential of the photosensitive drum 1 needs to be maintained to reduce the normal fog occurrence. In the present exemplary embodiment, if a potential difference is 150 V or more, the normal fog does not occur.

Moreover, when the developing bias Vdc approaches zero, fog tends to occur. This is a reversal fog phenomenon occurring when a reverse polarity toner (a toner having a polarity opposite to the normal charge polarity) is developed on the photosensitive drum 1. The reversal fog phenomenon tends to occur as a potential difference between the potential Vd of −500 V of the photosensitive drum 1 and the developing bias Vdc increases.

The developing bias Vdc needs to be set so that not only the fog does not occur with respect to non-image portion potential Vd1 (−500 V), but also a potential difference permitting toner development with respect to image portion potential V1 is ensured. In the present exemplary embodiment, a potential difference permitting toner development with respect to the image portion potential V1 (−100V) is 200 V or more.

The developing bias Vdc satisfying the fog and the development with respect to the non-image portion potential Vd1 (−500 V) and the image portion potential V1 (−100 V) is −350 V.

In the present exemplary embodiment, the surface potential of the photosensitive drum 1 subsequent to the charging is the primary charging potential Vd0 (−700 V) and the non-image portion potential Vd1 (−500 V).

The non-image portion potential Vd1 is set to have an appropriate potential difference so that the fog does not occur with respect to the developing bias Vdc. Consequently, if a width of the non-image portion potential Vd1, that is, a weak exposure width Lbg, is set wider than the developing width Ldev, the fog does not occur in an end thereof.

More specifically, a margin of 5 mm is set with respect to an LTR width of 216 mm to have a developing width of 221 mm. Then, a margin of 5 mm is set to the developing width to have a weak exposure width of 226 mm. That is, the following relationship is provided.

Developing width *Ldev*<weak exposure width *Lbg*

Accordingly, potential of the photosensitive member 1 in an end area of the developing width in a development position becomes Vd1=−500 V by weak exposure. Since the developing bias Vdc is −350 V, the potential difference between the developing bias Vdc and the primary charging potential Vd0 is as follows.

$$|-350\text{ V}-(-500\text{ V})|=150\text{ V}$$

Since this potential difference is within an appropriate range, the fog does not occur.

According to such a configuration, the image forming apparatus does not cause the fog to occur in an end.

Now, a comparative example of the present embodiment is described by using a case where a developing width Ldev and a weak exposure width Lbg have a relationship as follows.

Developing width *Ldev*>weak exposure width *Lbg*

In such a case, potential of a photosensitive member in an end area of a developing width in a development position does not undergo weak exposure, and thus a primary charging potential Vd0 becomes −700 V. Since a developing bias Vdc is −350 V, a potential difference between the developing bias Vdc and the primary charging potential Vd0 increases as follows.

$$|-350\text{ V}-(-700\text{ V})|=350\text{ V}$$

Such an increase of the potential difference can cause fog occurrences.

On the other hand, the present exemplary embodiment can provide an advantageous effect compared to the comparative example.

Figure 5:
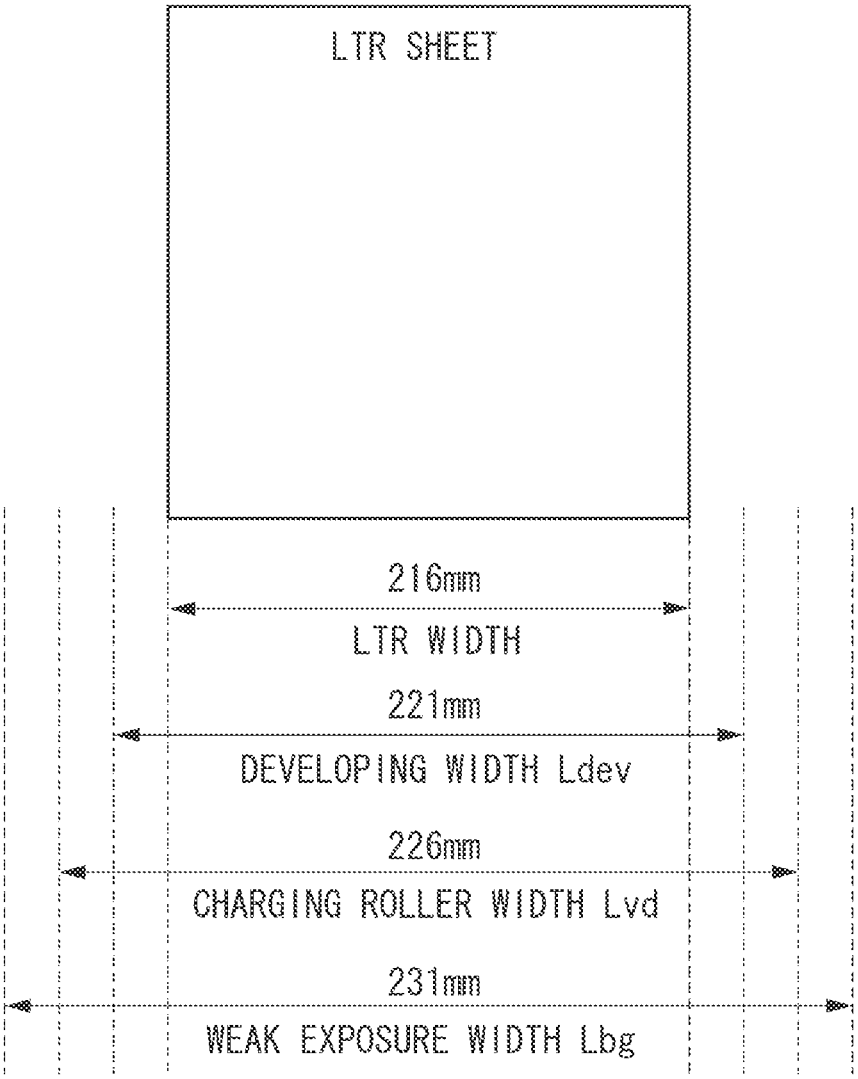
FIG. 5 is a diagram illustrating a relationship among lengths in a photosensitive member longitudinal direction of the image forming apparatus.

A modification of the present exemplary embodiment is described with reference to FIG. 5. In the present modification, a width of weak exposure is longer than the above description in consideration of a relationship between the width of weak exposure and a width of the charging roller 2.

A detailed description is given of a relationship between a weak exposure width (a length Lbg in a longitudinal direction of a photosensitive member on which non-image portion potential Vd1 is formed) and a charging roller width (a length Lvd in a longitudinal direction of a photosensitive member charged to a primary charging potential Vd0 by the charging unit) according to the modification of the present exemplary embodiment.

A width of the charging roller 2 is conventionally set wider than that of the weak exposure to reliably acquire the non-image portion potential Vd1. Herein, generation of a defective image due to overcharge of a photosensitive member as a problem of the direct current charging method can be suppressed by increasing an attenuation amount for attenuating from the primary charging potential Vd0 to the non-image portion potential Vd1.

However, if the charging roller width is set wider than the weak exposure width, the non-image portion potential Vd1 has an area in which the primary charging potential Vd0 is not attenuated. If the photosensitive layer 12 as an insulator has a dielectric strength of $7\times10^7$ V/m, the photosensitive layer 12 having a thickness of 10 μm reaches the limit of dielectric breakdown due to a potential difference with the aluminum cylindrical supporting member 11 connected to the ground with the charging potential of −700 V.

The dielectric strength changes depending on a component of the photosensitive layer 12. The photosensitive layer 12 can be thickened as a method for not only preventing dielectric breakdown but also not generating a defective image. However, the photosensitive layer 12 should be as thin as possible from a cost standpoint. The photosensitive layer 12 is worn and whittled by an image forming operation, and a thickness thereof becomes thinner. Consequently, if the photosensitive layer 12 becomes too thin, dielectric breakdown can occur, causing generation of a leak image.

In the present modification, a width of the weak exposure is further widened relative to a width of the charging roller 2 so that the weak exposure causes the entire width in which the primary charging potential Vd0 is formed to be attenuated to the non-image portion potential Vd1. That is the following relationship is set.

Charging roller width *Lvd*<weak exposure width *Lbg*

Herein, the following relationship is expressed.

Developing width *Ldev*<charging roller width *Lvd*<weak exposure width *Lbg*

This relationship is provided based on the aforementioned conditions as follows.

Developing width *Ldev*<weak exposure width *Lbg*,

Developing width *Ldev*<charging roller width *Lvd*

A length of the charging roller width is 226 mm where a margin length is set to 5 mm from the developing width. Similarly, where a margin length is set to 5 mm from the charging roller width, the weak exposure width becomes 231 mm.

The weak exposure width is a width of irradiation of laser beam from the exposure unit C. That is, an irradiation width of the laser beam is set wider than the width of the charging roller 2.

Since an area outside the width of the primary charging potential Vd0 serving as a width of the charging roller 2 is not charged by the charging roller 2, surface potential of the photosensitive drum 1 is zero. Even if this area is irradiated with the laser beam from the exposure unit C, the surface potential remains zero, thereby eliminating concern about problems such as occurrence of fog in which toner is moved from the developing roller 3 to a non-image portion of the photosensitive drum 1.

According to the modification of the present exemplary embodiment, a relationship among lengths in a photosensitive member longitudinal direction is summarized as follows.

*LTR* width<developing width<charging roller width<weak exposure width

According to such a configuration, the image forming apparatus does not cause fog to occur in an end or a lead image to be generated.

In the present modification, although a difference between the charging roller width Lvd and the weak exposure width Lbg is set to 5 mm, the difference is not limited thereto. However, it is desirable for the charging roller width Lvd and the weak exposure width Lbg to satisfy the following relationship with a value Ls illustrated in FIG. 6.

$Lbg-Lvd>Ls$, that is, $Lbg>Ls+Lvd$

Figure 6:
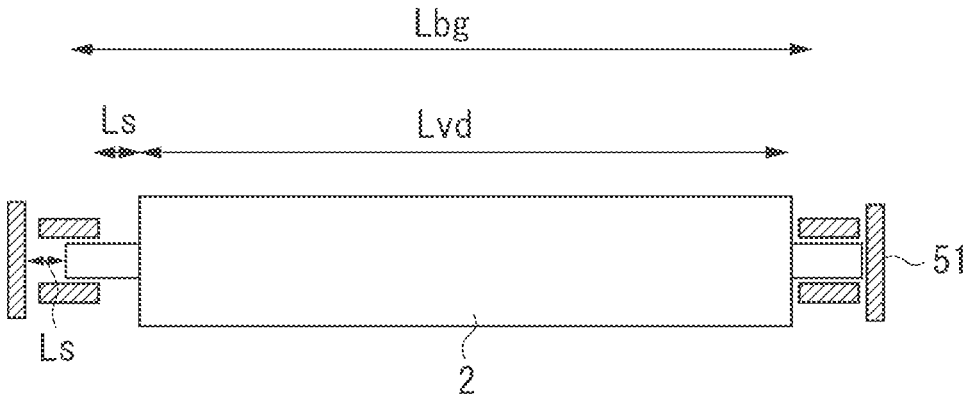
FIG. 6 is a diagram illustrating a charging roller.

As illustrated in FIG. 6, both ends of the shaft of the charging roller 2 are supported by the waste developer container 51 serving as a frame member of the photosensitive drum unit B. Herein, if backlash (space) is generated between a shaft of the charging roller 2 and a bearing disposed to the waste developer container 51, there are cases where the charging roller 2 is movable in a longitudinal direction thereof in an amount of the backlash. This movable distance of the charging roller 2 is Ls.

Herein, if a difference between the charging roller width Lvd and the weak exposure width Lbg is greater than the movable distance Ls of the charging roller 2 (if Lbg−Lvd>Ls), an outer side of the charging roller 2 (a charging area of the photosensitive drum 1) can reliably undergo the weak exposure regardless of a position of the charging roller 2.

The present exemplary embodiment is described to employ the direct current charging method in which bias applied to the charging unit is only a direct current component, since a defective image is likely to be generated by the DC charging method due to non-uniform charging. However, the present exemplary embodiment is not limited to the DC charging. For example, the present exemplary embodiment may be applied to an image forming apparatus capable of forming potential by exposing a non-image portion and an image portion to light using an alternating current (AC) charging method for performing charging by superimposing AC voltage to DC voltage.

Moreover, the present exemplary embodiment is described by using one exposure unit (the exposure unit C) as an example, the exposure unit serving as both an image exposure unit for forming image portion potential and a weak exposure unit for forming non-image portion potential. That is, in the present exemplary embodiment of the present invention, when an image forming apparatus includes an image exposure unit and a weak exposure unit, these units are not necessarily separate units unless otherwise stated.

Since the image exposure unit and the weak exposure unit are shared, additional weak exposure unit is not to be necessarily disposed, thereby simplifying a configuration of the image forming apparatus.

On the other hand, even if the image exposure unit and the weak exposure unit are not configured as one device, the present exemplary embodiment can suppress occurrence of fog in an end of the photosensitive member and generation of a defect image caused by faulty charging of the photosensitive member. In other words, the image exposure unit for forming image portion potential and the weak exposure unit for forming non-image portion potential may be independently disposed from each other.

Figure 7:
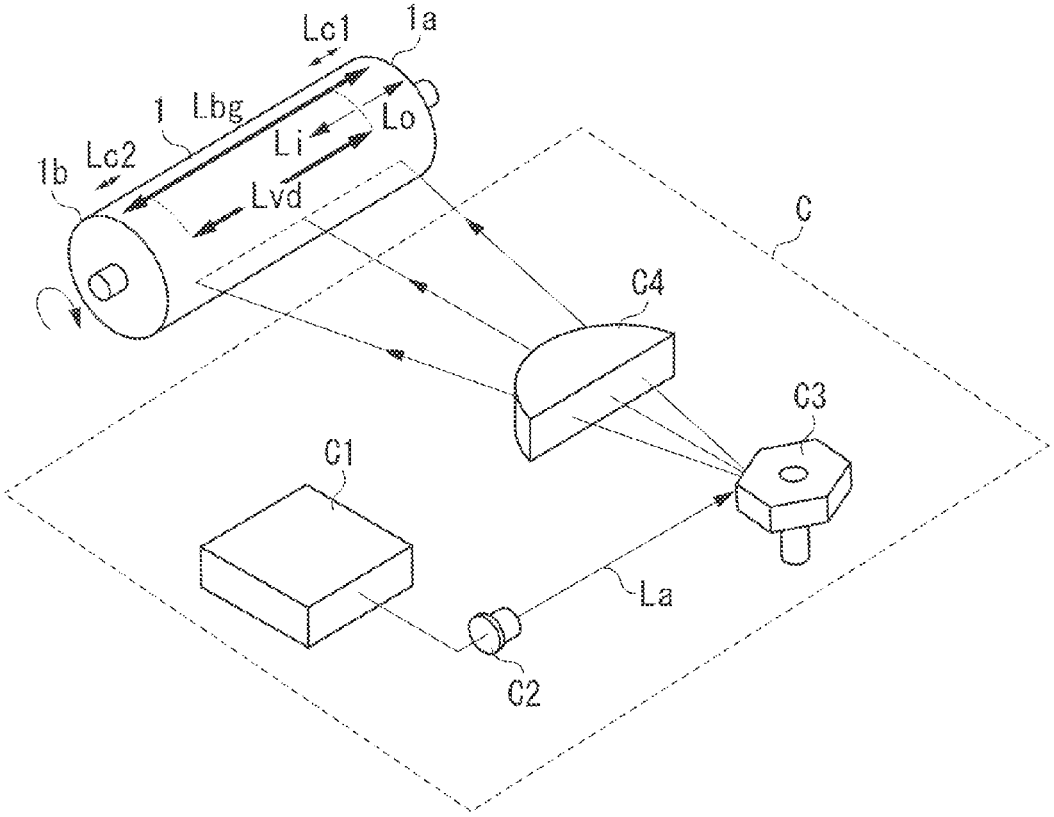
FIG. 7 is a diagram illustrating a photosensitive drum and an exposure unit C.

A second exemplary embodiment is described. A description of components similar to the first exemplary embodiment is omitted. FIG. 7 is a diagram illustrating a photosensitive drum 1 and an exposure unit C.

The photosensitive drum 1 includes a photosensitive layer 12 on a cylindrical supporting member 11 as illustrated in FIG. 2. There are cases where a thickness of the photosensitive layer 12 is not uniform in a longitudinal direction of the photosensitive drum 1. The thickness uniformity can depend on a manufacturing method for the photosensitive drum 1. In other words, there are cases where a thickness of the photosensitive layer 12 on a first end side 1*a* of the photosensitive drum 1 is thinner than that on a second end side 1*b*.

As described in the above exemplary embodiment, if the photosensitive layer 12 is thin, continuous charge by high potential can cause dielectric breakdown. Therefore, after the photosensitive drum 1 is exposed to light, it is desired for a thin area of the photosensitive layer 12 to be surely exposed to weak light by the exposure unit C to reduce potential thereof.

According to the present exemplary embodiment, an area exposed to the weak light (weak exposure area) on the first end side 1*a* of the photosensitive drum 1 is set wider than that on the second end side 1*b* since the thickness of the photosensitive layer 12 is thinner on the first end side 1*a* than that on the second end side 1*b*.

Assume that distances from an end of a charging area (a range of width Lvd) charged by the charging roller 2 to an end of the weak exposure area (range of width Lbg) exposed to the weak light by a weak exposure unit on the first end side 1*a* and the second end side 1*b* of the photosensitive drum 1 are respectively Lc2 on Lcb. Herein, assume that Lc1>Lc2.

Accordingly, the weak exposure is performed across a wide area (a range of width Lc1) on the thin photosensitive layer 12 on the first end side 1*a* of the photosensitive drum 1, so that an increase in potential of the photosensitive drum 1 is suppressed more reliably, thereby suppressing dielectric breakdown occurrence.

In a modification of the present exemplary embodiment, potential on the first end side 1*a* of the photosensitive drum 1 can be reliably reduced by increasing intensity of weak light exposed by a weak exposure unit to the first end side 1*a* to be higher than that to the second end side 1*b*.

Next, a third exemplary embodiment is described. An output of a weak exposure unit is changed at an end of a photosensitive drum 1 according to the third exemplary embodiment.

In the present exemplary embodiment as similar to the above exemplary embodiments, the weak exposure unit and an exposure unit for exposing an image portion to light are shared, and weak exposure is performed by an exposure unit C. As illustrated in FIG. 7, the exposure unit C causes a laser La emitted from a laser diode (laser emitting unit) C2 to be reflected by a polygonal mirror C3, and then the reflected light to pass through a lens C4, so that the light is applied to the photosensitive drum 1.

Herein, there are cases where intensity of a laser emitted to an end portion of the photosensitive drum 1 for exposure is deteriorated due to properties of the lens C4, for example. In the present exemplary embodiment in particular, the exposure unit C needs to perform weak exposure on an outer side of an end of a charging area (a range of width Lvd) on the photosensitive drum 1 charged by a charging roller 2. As a result, intensity of the weak exposure can be decreased, particularly, on the outer side of the charging area.

According to the present exemplary embodiment, an output of the laser emitted from the laser diode C2 toward the polygonal mirror C3 is changed when the exposure unit C performs the weak exposure on a portion near the end of the charging area. Herein, an output of the laser diode C2 for the weak exposure on an outer side (an area indicated by an arrow Lo) is set greater than an output of the laser diode C2 for weak exposure on an inner side (an area indicated by an arrow Li) near the end of the charging area (the range of width Lvd).

Therefore, even if intensity of the laser passing the lens C4 is decreased on an outer side of the charging area (the range of width Lvd), sufficient intensity for the weak exposure on the photosensitive drum 1 can be provided.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-267151 filed Dec. 6, 2011 and No. 2012-246487 filed Nov. 8, 2012, which are hereby incorporated by reference herein in their entirety.

What is claimed is:

1. An image forming apparatus for forming an image on a recording medium, the image forming apparatus comprising:

a photosensitive member;

a charging unit configured to charge the photosensitive member;

a developer bearing member configured to form a developer image on an image portion within a surface of the photosensitive member by supplying a developer to the image portion; and an exposure unit configured to expose the photosensitive member after the photosensitive member is charged by the charging unit, wherein the exposure unit exposes a non-image forming portion where the developer is not supplied on the surface of the photosensitive member to a non-image forming light having a lower exposure amount than an image forming light for exposing the image portion, wherein a relationship of Lvd<Lbg is satisfied where a length of a weak exposure area that the exposure unit is able to expose to the non-image forming light on the surface of the photosensitive member and that is measured in a photosensitive member longitudinal direction is Lbg, and a width of a charging area where the photosensitive member is charged by the charging unit on the surface of the photosensitive member and that is measured in the photosensitive member longitudinal direction is Lvd.

2. The image forming apparatus according to claim 1, wherein the exposure unit exposes the image portion to the image forming light.

3. The image forming apparatus according to claim 1, wherein a voltage applied to the charging unit is a direct current component.

4. The image forming apparatus according to claim 1, wherein the photosensitive member is charged to a same polarity as a normal polarity of the developer by the charging unit, and wherein $$|Vd0|>|Vd1|>|Vdc|>|V1| \text{ is satisfied}$$

where the photosensitive member charged by the charging unit has potential Vd0, the image portion has potential V1, the non-image portion has potential Vd1, and the developer bearing member has potential Vdc.

5. The image forming apparatus according to claim 1, wherein the photosensitive member and the developer bearing member are parts of a process cartridge detachable from a main body of the image forming apparatus.

6. The image forming apparatus according to claim 1, wherein the charging unit is a charging roller contacting the photosensitive member.

7. The image forming apparatus according to claim 6, wherein, when the charging roller is movable for a distance Ls in a longitudinal direction thereof, Lbg>Lvd+Ls is satisfied.

8. The image forming apparatus according to claim 1, wherein the photosensitive member includes a supporting member having conductivity and a photosensitive layer provided on the supporting member.

9. The image forming apparatus according to claim 8, wherein a thickness of the photosensitive layer of the photosensitive member on a first end side in a photosensitive member longitudinal direction is thinner than that on a second end side, and wherein a distance from an end portion of the charging area to an end portion of the weak exposure area in the photosensitive member on the first end side is longer than that on the second end side.

10. The image forming apparatus according to claim 9, wherein a thickness of the photosensitive layer of the photosensitive member on the first end side in a photosensitive member longitudinal direction is thinner than that on the second end side, and wherein an exposure amount of the non-image forming light is higher on the first end side than that on the second end side when the exposure unit exposes the non-image portion to the non-image forming light.

11. The image forming apparatus according to claim 1, wherein the exposure unit includes:

a laser emitting unit;

a polygonal mirror configured to reflect a laser emitted from the laser emitting unit; and a lens configured to cause the laser reflected from the polygonal mirror to pass therethrough, wherein, when the exposure unit exposes a portion near an end of the charging area to the non-image forming light, an output of the laser emitted from the laser emitting unit to the polygonal mirror is changed to increase an output of the laser emitted from the laser emitting unit to expose an outer side near the end of the charging area to be greater than an output of the laser emitted from the laser emitting unit to expose an inner side near the end of the charging area.

12. The image forming apparatus according to claim 1, wherein a relationship of $Ldev<Lvd<Lbg$ is satisfied, where a length of a portion where the developer bearing member carries the developer measured in the photosensitive member longitudinal direction is Ldev.

* * * * *